US007036402B1

(12) United States Patent
Marks et al.

(10) Patent No.: US 7,036,402 B1
(45) Date of Patent: May 2, 2006

(54) WATER MAIN T-BAR AND ADAPTOR

(75) Inventors: Joel S. Marks, Sherman Oaks, CA (US); Stephen Quick, West Boylston, MA (US)

(73) Assignee: Endeavor Tool Company, West Boylston, MA (US)

( * ) Notice: Subject to any disclaimer, the term of this patent is extended or adjusted under 35 U.S.C. 154(b) by 0 days.

(21) Appl. No.: 10/949,849

(22) Filed: Sep. 24, 2004

(51) Int. Cl.
*B25B 23/16* (2006.01)

(52) U.S. Cl. ..... 81/177.2

(58) Field of Classification Search ..... 81/177.2, 81/177.5, 177.85, 176.2, 121.1, 180.1, 53.1
See application file for complete search history.

(56) References Cited

U.S. PATENT DOCUMENTS

| | | | | | |
|---|---|---|---|---|---|
| 342,824 | A | * | 6/1886 | Clark | 81/125.1 |
| 394,733 | A | * | 12/1888 | Staats et al. | 137/367 |
| 613,652 | A | * | 11/1898 | Chadbourne | 137/366 |
| 845,717 | A | * | 2/1907 | Miller | 81/121.1 |
| 1,018,172 | A | * | 2/1912 | Downs | 81/177.2 |
| 1,493,983 | A | * | 5/1924 | Hurley | 81/177.2 |
| 1,759,221 | A | * | 5/1930 | Carson | 137/364 |
| 3,658,086 | A | * | 4/1972 | Hart | 137/368 |
| RE27,895 | E | * | 1/1974 | Ray | 137/15.08 |
| 4,178,816 | A | * | 12/1979 | Radice | 81/57.3 |
| 4,344,340 | A | * | 8/1982 | Erickson | 81/177.2 |
| 4,546,679 | A | * | 10/1985 | Burghardt | 81/119 |
| 4,806,170 | A | * | 2/1989 | Doty | 134/9 |
| 4,815,345 | A | * | 3/1989 | Radice | 81/57.3 |
| 5,134,905 | A | * | 8/1992 | Brennan et al. | 81/3.07 |
| 5,316,040 | A | * | 5/1994 | Townsend et al. | 137/556 |
| 5,320,003 | A | * | 6/1994 | Ely et al. | 81/57.4 |
| 5,706,709 | A | * | 1/1998 | Snow | 81/73 |
| 5,746,416 | A | | 5/1998 | Paylor | |
| 5,794,644 | A | * | 8/1998 | Paylor | 137/15.17 |
| 5,915,420 | A | | 6/1999 | Dwight, Jr. et al. | |
| 5,950,654 | A | * | 9/1999 | Paylor | 137/15.17 |
| 6,354,116 | B1 | | 3/2002 | Drake | |
| 6,379,020 | B1 | * | 4/2002 | Lewis et al. | 362/120 |
| 6,776,068 | B1 | * | 8/2004 | Reuschel et al. | 81/54 |

OTHER PUBLICATIONS

U.S. Appl. No. 10/930,919, filed Aug. 31, 2004, Marks et al.

* cited by examiner

*Primary Examiner*—David B. Thomas
(74) *Attorney, Agent, or Firm*—Paul Y. Feng; Fulwider Patton LLP

(57) ABSTRACT

A torque applying tool with a removable adaptor for actuating an underground valve of a fluid-carrying conduit, such as a water main, gas line, petroleum pipeline, etc. The adaptor has a hollow cylindrical sleeve for receiving an elongate rod of a T-bar tool, the rod and the sleeve being removably connected to each other by a bolt. The adaptor of the T-bar is configured to engage with a socket tool for application of torque to a valve, the adaptor including a nib shaped to closely fit within an opening in the socket tool. To prevent the socket from sliding off the adaptor during use, an optional spring loaded detent is provided on the adaptor to retain the socket in releasable connection with the T-bar.

11 Claims, 3 Drawing Sheets

WATER MAIN T-BAR AND ADAPTOR

FIELD OF THE INVENTION

This invention relates to a tool for activating a valve in a water line, fuel line, or other fluid conduit.

BACKGROUND OF THE INVENTION

Tools for activating valves in water lines, fuel lines, sewer lines, or the like, are used widely in the public utility field to operate a valve or other control components of conduits and pipelines located below ground level.

Typically, the tool may be required to operate a valve at considerable distance from or out of arm's reach of the workman or user, depending on the depth of the conduit beneath ground level. The workman will normally remain above ground level while extending the tool down through a manhole cover or like access hole into an access shaft to operate the valve remotely with the end of the tool.

One problem encountered with such tools is that a public utility workman sent to the site of a valve that must be operated on may not know at what depth below ground level he will find the valve when he arrives at the site giving access to the conduit. In such cases a public utility workman may be provided with a number of complete tools of different lengths, to deal with conduits at different depths. Furthermore, it may be found that the valve requires a socket with non-standard dimensions. In such a case, non-standard tools may have to be provided to the workman to cater for such an eventuality. These instances present the disadvantage of the cost and inconvenience of providing and maintaining a number of tools to meet with different conditions at an access point to a conduit valve.

Thus, a need exists in the art for a tool for actuating a valve of fluid lines buried below ground level that is easy to manufacture, easy to assemble, and which provides the user with a variable configuration for different conditions encountered in the field at an access shaft. These and other advantages of the invention will become more apparent from the following detailed description thereof and the accompanying exemplary drawings.

SUMMARY OF THE INVENTION

According to a preferred embodiment of the invention, an improved device for activating a valve on a fluid conduit is described. The improved device of the present invention is in the preferred form of a T-bar, configured to apply torque to a valve or other mechanical item. The T-bar is configured to cooperate with a socket shaped to torsionally engage with the valve or mechanical item.

In the preferred embodiment, the device includes a central elongated rod, extending between two opposing ends of the device. At one end an elongate handle may be fixed transverse to the rod, suitable for imparting a torque to the rod. At the opposing end of the rod, an adaptor is provided to be releasably connected to the rod.

In a preferred embodiment, the adaptor includes a hollow cylindrical sleeve configured to receive the rod at one end. At the other end, the adaptor includes an engagement element connected to the sleeve, the engagement element being adapted to act in unison with the sleeve and configured to cooperate with a socket to impart a torsional force thereto.

A preferred means by which the adaptor may be formed to cooperate with a socket is through an elongate nib, of generally square section, fixed to the adaptor and shaped to closely engage with a mating opening in the socket.

To prevent a socket installed on the adaptor from sliding off the adaptor during use, a detent may be provided on the nib, configured to engage with a mating shape in the opening in the socket so as to removably retain the socket on the adaptor.

These and other advantages of the invention will become more apparent from the following detailed description thereof and the accompanying exemplary drawings.

DETAILED DESCRIPTION OF THE PREFERRED EMBODIMENTS

Figure 1:
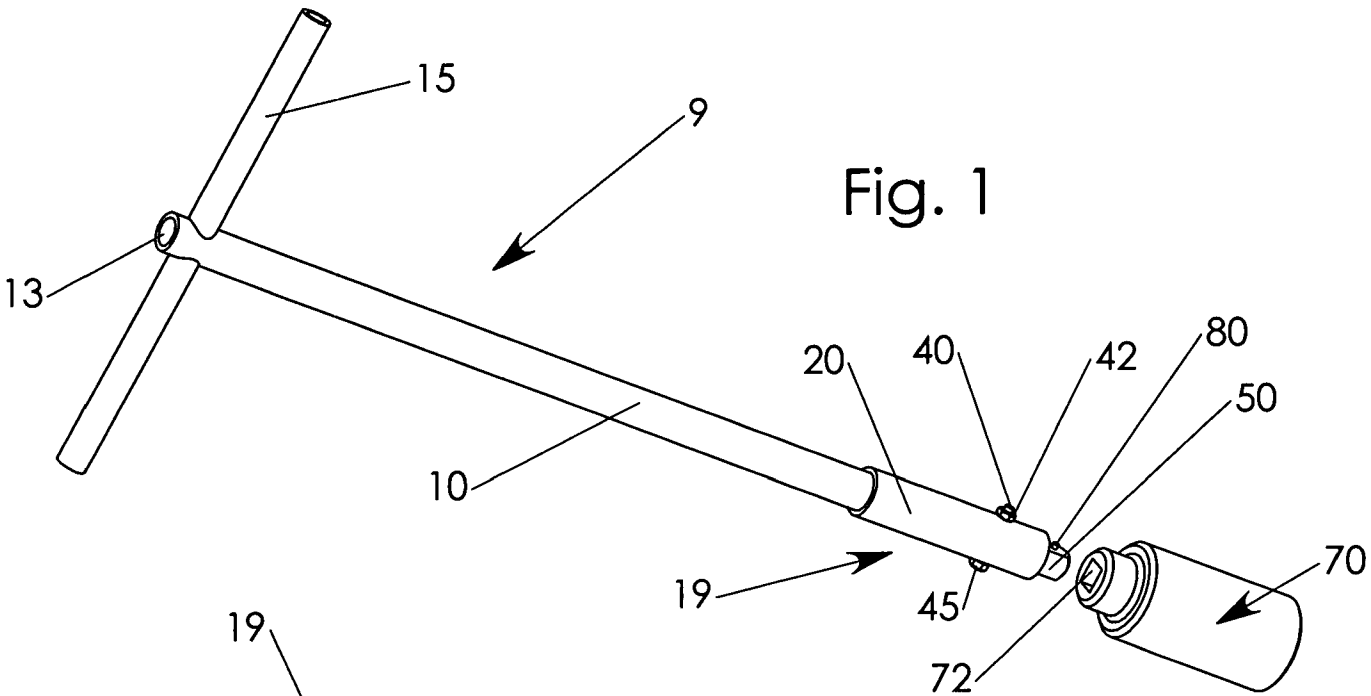
FIG. 1 is an oblique perspective view of a T-bar with adaptor showing aspects of the invention, shown in relation to a socket tool for remotely activating a valve of a conduit.
Figure 2:
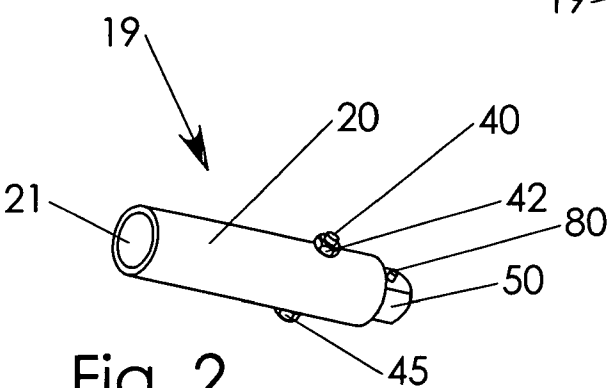
FIG. 2 is a perspective view of an adaptor, a component of the T-bar of FIG. 1.
Figure 3:
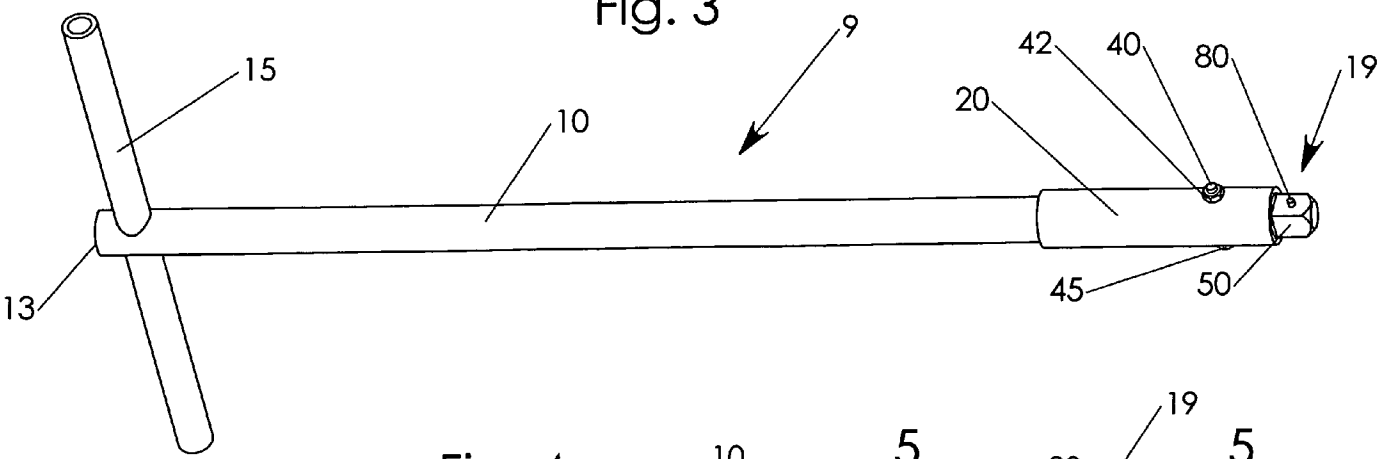
FIG. 3 is a side perspective view of the T-bar of FIG. 1.
Figure 4:
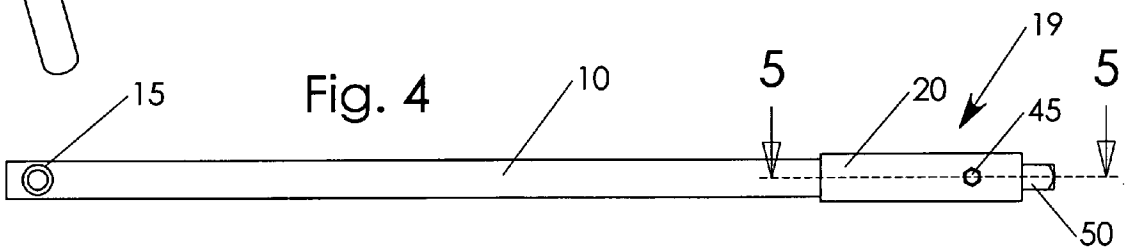
FIG. 4 is a side elevational view of the T-bar of the previous Figures.

With reference to the drawing figures, a preferred embodiment of the present invention is described, namely a T-bar (generally described by the reference numeral 9) configured to work in combination with a socket tool, the combination forming a key for actuating an underground valve in a water main, sewer line, gas line, petroleum pipeline, fuel line, etc. The socket tool may be of the type shown in, for example, U.S. Ser. No. 10/930,919, filed Aug. 31, 2004, by Joel S. Marks, titled "Large Self-Forming Socket," whose entire contents are hereby incorporated by reference. Such a socket tool features spring loaded pins that adapt or conform to the valve stem, handle, or nut shape and size. The pins are bundled in parallel inside a housing and collectively gain purchase on and apply the torque necessary to open or close the valve. Naturally, conventional socket tools can also be used with the present invention T-bar.

Figure 6:
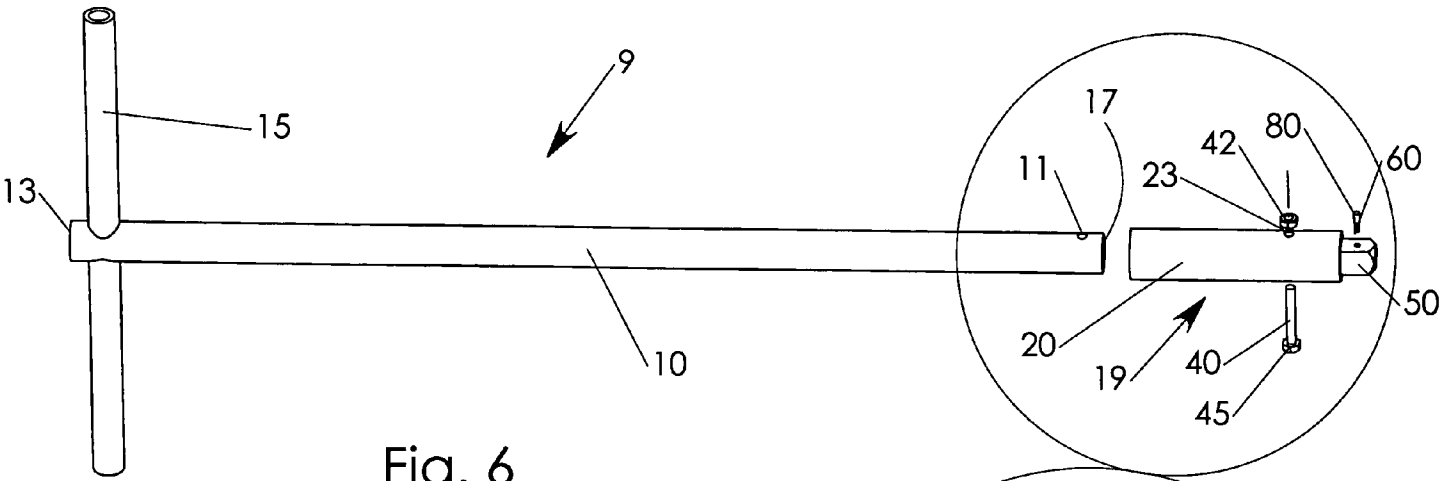
FIGS. 6 and 7 are perspective views of aspects of the T-bar of the previous Figures in disassembled configuration, showing the relationship between the adaptor and the rod components of the T-bar.
Figure 7:
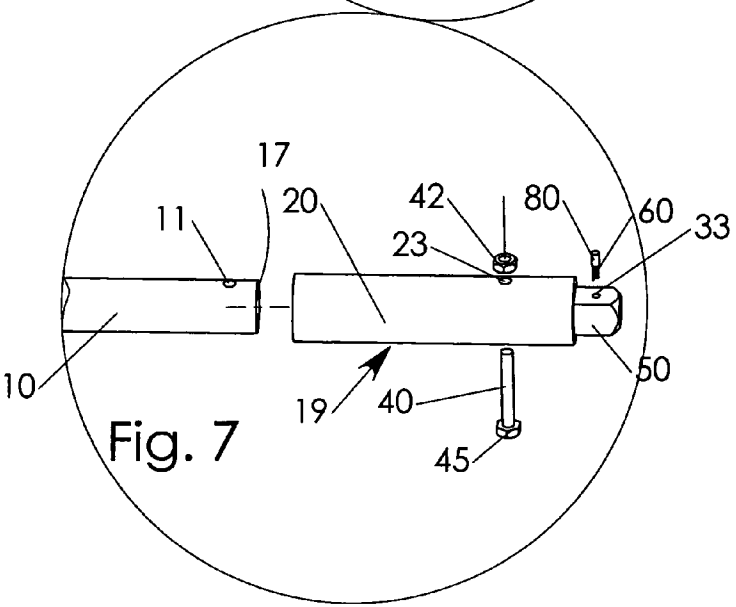

The central portion of the T-bar 9 includes an elongate rod 10 preferably of cylindrical form, with opposing ends 13, 17 (FIG. 6) and having a width and thickness selected to withstand the torsional force that the T-bar may be required to apply during activation of a valve (not shown). In a preferred embodiment the rod may be hollow, but a solid rod may be required depending on the amount of torque the rod will be required to transmit. If hollow, the rod may have internal diametrical cross bars or solid sections to improve torsional and bending strength.

At one end 13 of the rod 10, a transverse handle 15 is connected to the rod. In one preferred embodiment, a suitable transverse hole may be drilled in the rod 10 for positioning the handle 15 therethrough. In another embodiment the handle 15 may simply be welded to the end 13 of the rod 10. In another embodiment, the transverse handle may extend on only one side of the rod to describe an L-bar. The length of the handle 15 is selected to facilitate application of a torsional force to the rod 10, the diameter and thickness of the handle being selected to withstand the bending moment developed by imparting the required torsion. Again, the handle 15 may be hollow in a preferred embodiment, or it may be solid depending on the torsional and bending forces it is required to develop.

At the end 17 of the rod 10 opposite the handle 15, an adaptor generally described by the numeral 19 is provided. As best exemplified in FIG. 5, the adaptor 19 includes a hollow cylindrical sleeve 20. One end 24 of the sleeve is open, preferably configured to snugly receive the free end 17 of the rod 10. The opposite end 26 of the sleeve 20 is closed by an engagement element 52 (FIG. 5) connected to the sleeve and configured to torsionally engage a socket 70 (FIG. 1) that will activate a valve (not shown). The engagement element 52 is formed to operate in unison with the sleeve 20. Such may be optimally achieved by forming the sleeve 20 and the engagement element 52 from a single piece, either by hollowing out the center of the sleeve from a starting rod of metal, or by forging the combination in one piece by a conventional method.

Because the valve to be operated is typically buried underground, and may not have been accessed for sometimes many years, and is often rusted in place, the necessary torque needed to rotate the valve stem, handle, or nut may be extremely large. Consequently, the possibility of a broken bar or other types of tool failure exists. Therefore, it is preferable that the sleeve 20 be used as an optional reinforcement for the portion of the rod 10 that is underground. If failure in the rod 10 should occur above-ground, it is a trivial matter to replace the rod. However, if the section of the rod that is near the underground end 17 should fail or break off while inside a narrow shaft leading to a water main, for instance, access to the water main is impeded because the broken component might not be retrievable. Heavy equipment is then needed to dig through concrete, pavement, or soil to open up the shaft to gain access to the valve.

Moreover, the use of the sleeve 20 or the like for strength reinforcement further eliminates the need to make the rest of the rod 10 from heavy walled or bulky materials. Only the underground section needs to be strengthened. Moreover, the torque, shear, and other load bearing structures from the sleeve wall to the fastener or bolt 40 are preferably reinforced or increased in size and thickness for increased durability and load bearing capability.

At the underground end 26, the engagement element 52 includes an elongate nib 50 or block of generally square section, configured to engage a mating opening 72 (FIG. 1) of the socket tool 70 for torque transfer from the T-bar to the socket tool. The engagement is not permanent so the socket tool may be removed from the T-bar at will.

For example, a further aspect of the adaptor 19 is that it may include a spring loaded detent configured to provide a detaining force on a socket mounted on the T-bar. Preferably the detent comprises a generally cylindrical metal dowel 80 (FIG. 5) set within a cylindrical hole 33 formed in the nib. A spring may be positioned in the hole beneath the dowel, to provide an outwardly acting force. The dowel may be retained within the hole by providing the dowel with a shoulder, then peening the metal surface around the hole to reduce the diameter thereof around the shoulder of the dowel to prevent the dowel from being entirely propelled out of the hole by the spring 60. Once installed within the hole, the spring loaded dowel may engage with a mating generally cylindrical shape within the opening 72 of a socket 70 mounted on the nib 50, to prevent the socket tool from sliding off the nib during use. It will be appreciated that, where the detent is generally cylindrically shaped, disconnection from a socket may require secondary action to depress the dowel into the hole 33 to enable such connection or disconnection. An example of secondary action may include providing an access hole in the socket (e.g. an extension of the mating shape on the socket through to the exterior of the socket), to enable the user to depress the dowel with a sharp tool from outside the socket. In an alternative embodiment, the detent may be a spherical ball, rather than cylindrically shaped. It will be appreciated that this shape may allow disconnection from a socket having a concave mating shape, without the need for secondary action.

Figure 5:
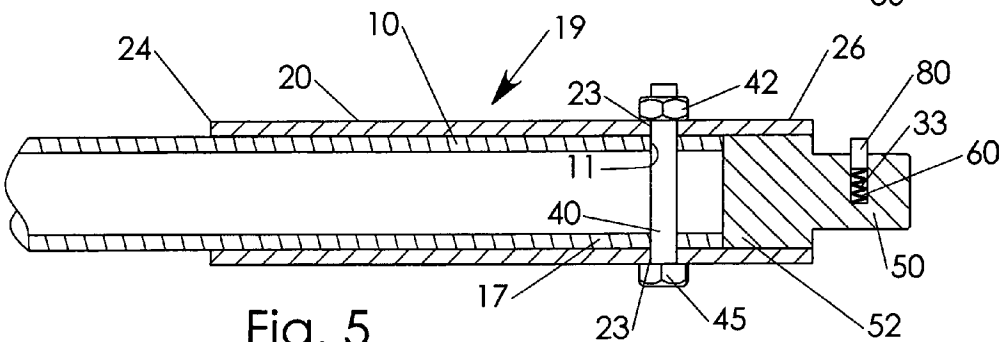
FIG. 5 is a large scale sectional view of an end of the T-bar taken substantially along line 5—5 in FIG. 4.

Once the elements of the adaptor 19 have been combined as above, the end 17 of the rod 10 may be inserted into the open end 24 of the sleeve 20. At least one hole 23 may be drilled through the sleeve and a corresponding hole 11 through the rod (as best seen in FIG. 5) to allow a bolt 40 having a retaining head 45 to be inserted therethrough. A nut 42 placed on a threaded end of the bolt 40 holds the bolt in place, thereby holding the adaptor 19 in axial and rotational fixed relation to the rod 10.

It will be appreciated, however, that the adaptor 19 is removable from the rod. This feature has the advantage of versatility in that, where the rod 10 is of insufficient length to reach a valve below ground level, a longer rod may be fitted to the adaptor 19. Further, should a socket 70 with an opening 72 (FIG. 1) that is non-standard in shape be required for use with a particular valve, the nib 50 of the adaptor may be found not to cooperatively fit in the opening. In such a case, the fitted adaptor 19 may be removed from the rod 10, and a different adaptor, configured to cooperate with the socket's non-standard opening, may be installed as a simple and quick replacement while in the field.

The resulting T-bar, when used in combination with a socket, provides a useful and economical means for torsionally actuating a valve in a conduit, or other mechanical purpose. The ease with which cooperating parts may be interchanged provides a versatile tool that may be reconfigured to address unforeseen problems at the work site.

In various alternative embodiments, the adaptor 19 may be permanently welded, soldered, brazed, or adhesively bonded to the rod 10. Or it may formed as part of the rod during a drawing or swaging process. In these embodiments, the adaptor would of course not be interchangeable.

Because the present invention is intended for use on water mains, gas lines, fluid conduits, the size and dimensions of the T-bar 9 and the needed socket tools may have to be fairly substantial. For instance, the socket tool in water main applications used with the T-bar may typically weigh 5 to 15 lbs. Accordingly, the T-bar handle 15 and rod 10 preferably may have a tubing diameter of ¼ inch to 2 inch inclusive, and preferably 1 inch to 2 inches in an upper range, with a wall thickness of preferably 0.1 to 0.25 inches at the reinforced areas. The T-bar handle 15 is ideally between 1 and 3 feet long. These dimensions have been found to be sufficient in an upper range to generate a torque of between 500 to 1000 ft. lbs needed for the intended industrial applications of actuating water and gas main valves, etc.

In various embodiments, the tubing and/or adaptor is made from iron or steel that may be zinc plated, chrome plated, painted, and/or polymer powder coated for protection against rust or the highly corrosive environments that are found in and around water mains, gas valves, petroleum pipelines, etc. Without such protective coating, the corrosive and harsh environments will slowly damage the T-bar until an unexpected failure or malfunction. Alternatively, these elements may be made of stainless steel or other high strength corrosion resistant material.

While a particular form of the invention has been illustrated and described, it will also be apparent to those skilled in the art that various modifications can be made without departing from the spirit and scope of the invention. Accordingly, it is not intended that the invention be limited except by the appended claims.

We claim:

1. A device for activating a valve on a fluid conduit, comprising:

an elongate rod; and an adaptor configured to be removably connected to an end of the rod by a bolt inserted through both the sleeve and the rod, the adaptor including a hollow cylindrical sleeve configured to receive the rod, and an engagement element connected to the sleeve, the engagement element being adapted to act in unison with the sleeve and configured to cooperate with a socket tool;

wherein the adaptor is connected to the rod by at least one bolt inserted through both the sleeve and the rod.

2. The device of claim 1, further including a handle fixed transversely to the rod, for applying torsion to the rod.

3. The device of claim 1, wherein the adaptor includes a nib configured to be inserted into a socket.

4. The device of claim 3, wherein the nib includes a spring loaded detent.

5. The device of claim 1, wherein the engagement element and the sleeve are formed from a single piece of metal.

6. A torque applying tool for use on an underground fluid-carrying conduit, comprising:

an elongate tube with an underground end and an above-ground end;

a handle disposed at the above-ground end;

a sleeve connected to the underground end by at least one bolt inserted through the sleeve, the sleeve having a means for rotationally affixing the sleeve to the elongate tube; and a block disposed at an end of the sleeve for engaging a socket tool.

7. The torque applying tool of claim 6, wherein the tool is at least partially covered by at least one of chrome plate, zinc plate, or a polymer coating.

8. The torque applying tool of claim 6, wherein the tube has a wall thickness of about 0.1 to 0.25 inches and a diameter of about 0.25 to 2 inches.

9. A device for applying torque to a valve on an underground fluid-carrying conduit, comprising:

an elongate rod;

means for applying torque to the rod at an above-ground end;

means for transmitting the torque from the rod to a socket at a below-ground end;

wherein the means for transmitting torque from the rod to a socket is connected to the rod by at least one bolt inserted through the means of transmitting torque.

10. The device of claim 9, wherein the means for transmitting torque to a socket includes a means for reinforcing the rod at the below-ground end.

11. The device of claim 9, wherein the means for transmitting torque from the rod to a socket includes means for releasably attaching the socket to the device.

* * * * *